US012084856B2

(12) United States Patent
Fleisch et al.

(10) Patent No.: US 12,084,856 B2
(45) Date of Patent: Sep. 10, 2024

(54) MODULAR WALL SYSTEMS

(71) Applicant: The Manufacturing Company, LLC, Cincinnati, OH (US)

(72) Inventors: Michael J. Fleisch, Cincinnati, OH (US); Sita Magnuson, Easthampton, MA (US); Michael Stone, Holyoke, MA (US)

(73) Assignee: The Manufacturing Company, LLC, Cincinnati, OH (US)

( * ) Notice: Subject to any disclaimer, the term of this patent is extended or adjusted under 35 U.S.C. 154(b) by 0 days.

(21) Appl. No.: 17/568,550

(22) Filed: Jan. 4, 2022

(65) Prior Publication Data

US 2022/0127845 A1 Apr. 28, 2022

Related U.S. Application Data

(63) Continuation of application No. 16/877,096, filed on May 18, 2020, now Pat. No. 11,286,663.

(60) Provisional application No. 63/016,656, filed on Apr. 28, 2020, provisional application No. 62/849,767, filed on May 17, 2019.

(51) Int. Cl.
*E04B 2/74* (2006.01)
*E04B 1/32* (2006.01)

(52) U.S. Cl.
CPC ..... *E04B 2/7405* (2013.01); *E04B 1/3211* (2013.01); *E04B 2001/327* (2013.01); *E04B 2001/3276* (2013.01); *E04B 2001/3294* (2013.01); *E04B 2002/7488* (2013.01)

(58) Field of Classification Search
CPC ..... E04B 2/7405; E04B 2002/7488; E04B 2001/327; E04B 2001/3294; E04B 1/3211; E04B 2001/3276
USPC .... 52/DIG. 10, 234, 238.1, 239, 481.2, 578, 52/80.1, 81.1
See application file for complete search history.

(56) References Cited

U.S. PATENT DOCUMENTS 3,061,977 A * 11/1962 Schmidt ..... E04B 1/3211 D25/13
3,255,556 A * 6/1966 D Amato ..... E04B 7/105 52/800.11
3,296,755 A * 1/1967 Chisholm ..... E04B 7/10 52/745.19
3,660,952 A * 5/1972 Wilson ..... E04B 1/10 D25/13
3,810,336 A * 5/1974 Sadao ..... E04B 1/3211 D25/13
3,858,372 A * 1/1975 Wilson ..... E04C 2/40 52/656.1
4,009,543 A * 3/1977 Smrt ..... E04B 1/3211 52/81.3
4,611,441 A * 9/1986 Wickens ..... E04B 1/3211 52/81.4

(Continued)

FOREIGN PATENT DOCUMENTS

CN 207433377 U * 6/2018
DK 141943 B * 1/1976

*Primary Examiner* — Brent W Herring
(74) *Attorney, Agent, or Firm* — Frost Brown Todd LLP

(57) ABSTRACT

A modular wall structure can include a first modular unit having a first face defined by a first perimeter and a second modular unit having a second face defined by a second perimeter. The first modular unit can be operably and selectively coupled to the second modular unit. Base units can be provided to support the first and second modular units.

15 Claims, 11 Drawing Sheets

(56) References Cited

U.S. PATENT DOCUMENTS 4,750,807 A * 6/1988 Chamayou dit Felix ..... G03B 21/56 359/451
4,907,382 A * 3/1990 Schwam ..... E04B 1/3211 52/81.1
5,168,677 A * 12/1992 Pronsato ..... A63F 9/1208 52/81.1
5,261,194 A * 11/1993 Roberts ..... E04B 1/3211 52/561
5,378,056 A * 1/1995 Wilson ..... A47F 5/0838 312/249.8
5,452,555 A * 9/1995 Lee ..... E04C 2/384 52/584.1
5,560,151 A * 10/1996 Roberts ..... E04B 1/3211 52/249
5,732,518 A * 3/1998 Roberts ..... E04B 1/3211 52/604
5,873,206 A * 2/1999 Roberts ..... E04B 1/3211 52/249
6,076,318 A * 6/2000 Grimm ..... E04B 1/3211 52/249
6,282,849 B1 * 9/2001 Tuczek ..... E04B 1/32 52/648.1
7,770,338 B2 * 8/2010 Nefzi ..... B29C 70/865 52/648.1
8,365,474 B2 * 2/2013 McSweeney ..... E04B 1/3211 52/81.4
9,458,620 B2 * 10/2016 Sevtsuk ..... E04B 7/105
10,392,800 B1 * 8/2019 Shin ..... E04B 1/04
2002/0059777 A1 * 5/2002 Saebi ..... E04B 7/102 52/200
2008/0209821 A1 * 9/2008 Nefzi ..... B29C 70/865 52/173.1
2010/0050558 A1 * 3/2010 Roberts ..... E02B 3/04 52/655.1
2010/0058676 A1 * 3/2010 Roberts ..... E04B 1/3211 403/388
2012/0204496 A1 * 8/2012 McSweeney ..... E04B 1/3211 52/80.1
2016/0024780 A1 * 1/2016 Sevtsuk ..... E04B 7/105 52/578

* cited by examiner

MODULAR WALL SYSTEMS

CROSS REFERENCE TO RELATED APPLICATIONS

This application claims priority to U.S. application Ser. No. 16/877,096, filed May 18, 2020, which is incorporated herein by reference in its entirety. This application also claims priority to U.S. Provisional Application No. 62/849,767, filed May 17, 2019, and U.S. Provisional Application No. 63/016,656, filed Apr. 28, 2020, both of which are incorporated herein by reference in their entireties.

TECHNICAL FIELD

Embodiments of the technology relate, in general, to modular wall systems, and in particular to modular wall structures formed from a system of interconnected individual units.

BACKGROUND

Work areas, cubicles, and other partitioned areas are often installed in a variety of locations, such as offices, event centers, and classrooms, where larger rooms, communal work spaces, and even home offices and study areas must be divided into smaller, more private work spaces. Conventional structures for providing such areas typically include an intricate framework for uprightly supporting a number of partitions. Such structures may be complex, and thus difficult and time-consuming to assemble and disassemble. Conventional framework and partitions can be heavy and cumbersome, and thus can be difficult to transport or move between rooms. In some cases, such conventional structures may not allow electrical or data-transmission wiring associated with telephones, computers, and other typical office equipment to be easily concealed, inspected or rerouted.

Accordingly, there is a need for modular wall system that overcomes the above-described disadvantages associated with conventional structures. The present invention addresses this need by providing a plurality of individual units that may be easily and efficiently interconnected with little or no framework to provide modular wall structures and work surfaces that can offer a wide range of functionality in a variety of modular wall system configurations.

SUMMARY

In accordance with one embodiment, a modular wall structure includes (a) a first modular unit, the first modular unit having a first face defined by a first perimeter; and (b) a second modular unit, the second modular unit having a second face defined by a second perimeter. The first modular unit is operably and selectively coupled to the second modular unit.

In accordance with another embodiment, a modular wall structure includes a first triangular unit and a second triangular unit. The first triangular unit includes a first frame, the first frame including a first side panel, a second side panel, and a third side panel, and a first face, wherein each of the first triangular unit first side panel, second side panel, and third side panel project outwardly from the first face. The second triangular unit includes a second frame, the second frame including a first side panel, a second side panel, and a third side panel, and a second face, wherein each of the second triangular face first side panel, second side panel, and third side panel project outwardly from the second face. The first frame of the first triangular unit is operably and selectively coupled with the second frame of the second triangular unit.

In accordance with yet another embodiment, a modular wall structure includes (a) a base unit, (b) a first modular unit, and (c) a second modular unit. The base unit has wheels and is electrically wired for power. The first modular unit has a first face, the first face having at least three sides, wherein each of the at least three sides is pivotable from 70° to 120° relative to the first face from a first unassembled configuration to a second assembled configuration. The first modular unit is electrically coupled with the base unit. The second modular unit has a second face, the second face having at least three sides, wherein each of the at least three sides is pivotable from 70° to 120° relative to the second face from a first unassembled configuration to a second assembled configuration. The second modular unit is electrically coupled with the first modular unit. The first modular unit and the second modular unit are selectively coupled with the base unit with a fastener selected from the group consisting of magnets, pins, bolts, U-channels, clamps, and combinations thereof.

BRIEF DESCRIPTION OF THE DRAWINGS

The present disclosure will be more readily understood from a detailed description of some example embodiments taken in conjunction with the following figures.

DETAILED DESCRIPTION

Figure 1:
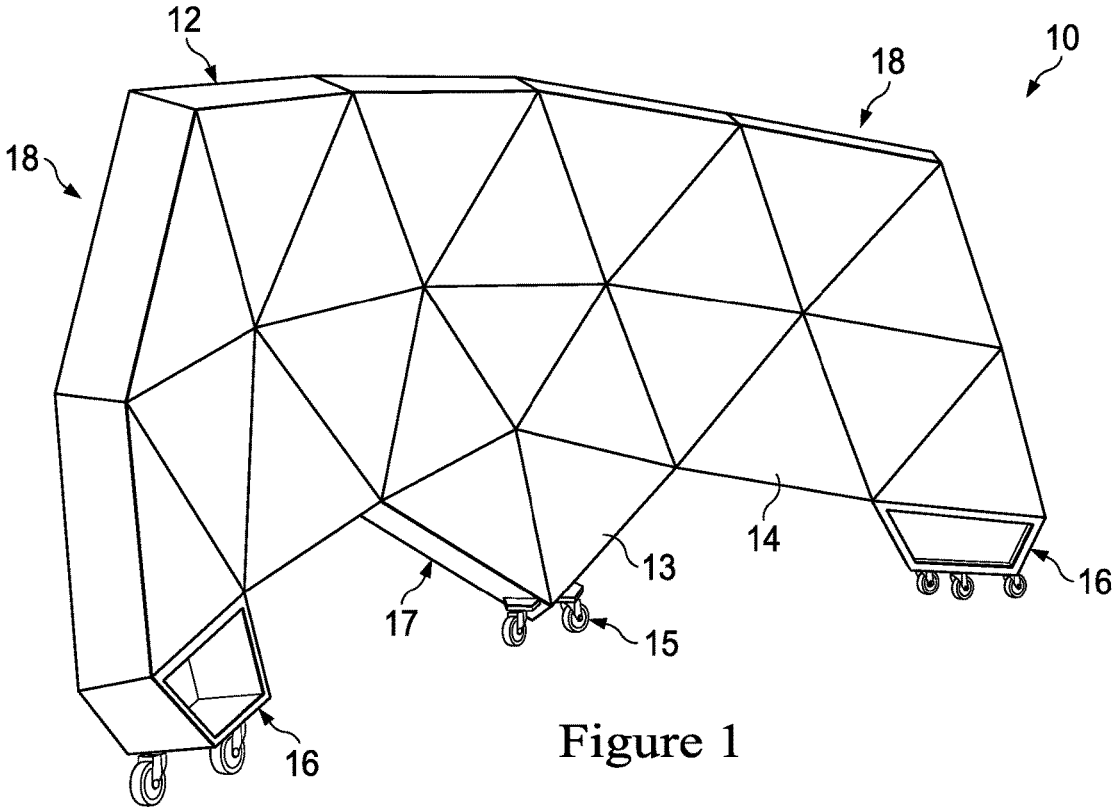
FIG. 1 depicts an example wall structure according to one embodiment.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Described herein are example embodiments of apparatuses, structures, and methods associated with modular wall systems. In one example embodiment, a modular wall system can include one or more modular wall structures formed of a plurality of building units. In some embodiments, the modular wall systems can include one or more work surfaces formed from the building units. In some embodiments, the modular wall systems include temporary or permanent partitions and/or enclosures to define work stations and meeting areas for individuals and groups in offices, schools, conventions, and a variety of other situations. In some embodiments, the modular wall systems can be lightweight and readily transportable without disassembly. In some embodiments, the modular wall systems can be powered work stations, where one or more building units can provide a wide range of functionality.

The examples discussed herein are examples only and are provided to assist in the explanation of the apparatuses, devices, systems and methods described herein. None of the features or components shown in the drawings or discussed below should be taken as mandatory for any specific implementation of any of these apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Example embodiments described herein can allow for improved flexibility in providing modular wall structures and work surfaces that conform to the specific needs of a space and persons occupying the same. For example, modular wall structures can be easily and efficiently assembled in a variety of configurations, and then disassembled as well. The modular nature of the wall systems, which can include a plurality of building units, may allow for enhanced transportability and quick transformation of the wall structures and surfaces. Moreover, such enhanced transportability can extend to wall structures and surfaces in assembled configurations with wheeled base units. Additionally, the building units improve ease of use as the units can rely on little to no additional framework.

Referring now to FIG. 1, a modular wall structure includes a plurality of building units. The modular wall structure can provide a partition to define a work space or meeting area for an individual or group. In certain embodiments, two or more of the modular wall structures may cooperate to define multiple work spaces and/or create enclosures. As shown in FIG. 1, the modular wall structure can have a curved shape and provide a contemporary look. It will be appreciated, however, that the modular wall structure can be provided in any of a variety of suitable styles and configurations, including configurations where a wall surface or a portion thereof is substantially flat and configurations that define one or more windows.

As shown in FIG. 1, the modular wall structure 10 can be formed of the plurality of building units 12. The building units 12 can be operably and selectively coupled to each other. For example, in certain embodiments, individual building units 12 can be held together by, for example, magnetic forces. In certain embodiments, the plurality of building units 12 can include triangular-shaped panels of different sizes. For example, as shown in FIG. 1, the plurality of building units 12 can include first triangular units 13 and second triangular units 14. Further, the modular wall structure 10 can be supported by base units, some of which can include wheels. In particular, and as shown in FIG. 1, the modular wall structure 10 can be supported by a wheeled center base unit 15, near a center of the modular wall structure 10, and wheeled end base units 16 at each end of the modular wall structure 10. In addition to supporting the modular wall structure 10, the wheeled center and end base units 15, 16 can also allow the modular wall structure 10 to be easily transportable without requiring disassembly of the same. In other embodiments, and as provided herein, modular wall structures can be supported by stationary base units that do not include wheels.

The first and second triangular units 13, 14 can be arranged to create modular wall structures 10 of a variety of configurations. As shown in FIG. 1, some first triangular units 13 can combine to form a pentagon-shaped portion 17 of the modular wall structure 10, some second triangular units 14 can combine to form hexagon-shaped portions 18 of the modular wall structure 10, while other first and second triangular units 13, 14 can be included around and adjacent to such sub-structures. The first and second triangular units 13, 14 are arranged in FIG. 1 to give the modular wall structure 10 a particular curvature which can facilitate its stability. In certain embodiments, a modular wall structure can form a geodesic structure or a portion thereof. In certain embodiments, the modular wall structure 10 can possess sufficient stability with or without the support of base units. It will be appreciated, however, that other suitable configurations could also provide sufficient stability for a modular wall structure.

Figure 2:
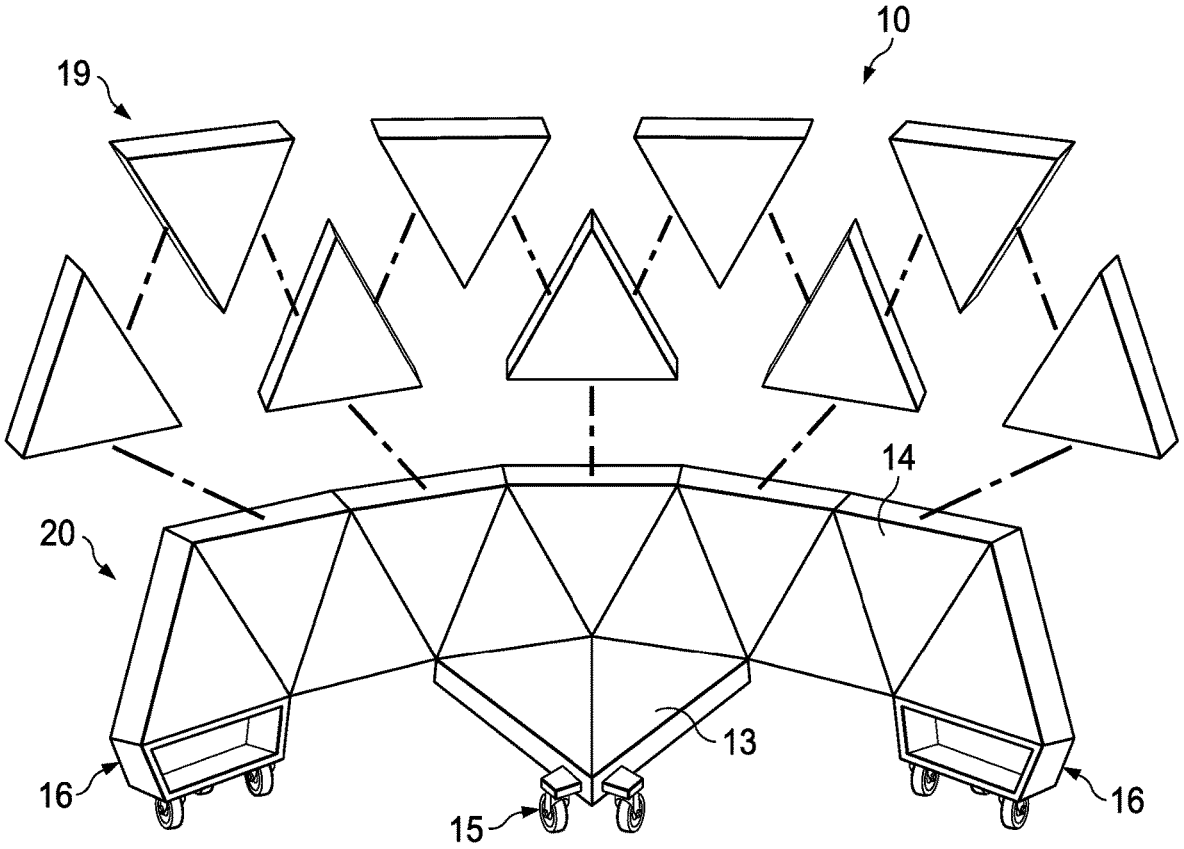
FIG. 2 depicts a partially exploded view of the wall structure of FIG. 1.

In certain embodiments, one or more of the first and second triangular units 13, 14 can be removable from the modular wall structure 10. For example, and as best shown in FIG. 2, one or more of the first and second triangular units 13, 14 forming a top row 19 of a modular wall structure 10 can be removable a bottom row 20. In such embodiments, the first and second triangular units 13, 14 of the top row 19 can be temporarily distributed among users and subsequently reattached to the modular wall structure 10. In one example, one of the first and second triangular units 13, 14 of the top row 19 can be taken by a user or group of users as part of a breakout session and function as a table and/or as a board for notetaking. However, it will be appreciated that an individual first or second triangular unit can provide any of a variety of functions, not limited to those that are described herein.

In certain embodiments, the bottom row 20 can help to retain the stability of the modular wall structure 10 and can maintain such stability without the first and second triangular units 13, 14 of the top row 19. While the modular wall structure 10 of FIGS. 1 and 2 is shown to include the support of wheeled center and end base units 15, 16, in other embodiments, the modular wall structure 10 can retain sufficient stability with the support of fewer or no base units. Without the top row 19, the bottom row 20 of the modular wall structure 10 can still deliver the functionality described above, while providing a support structure for reattachment of the first and second triangular units 13, 14 of the top row 19, if necessary.

Figure 3:
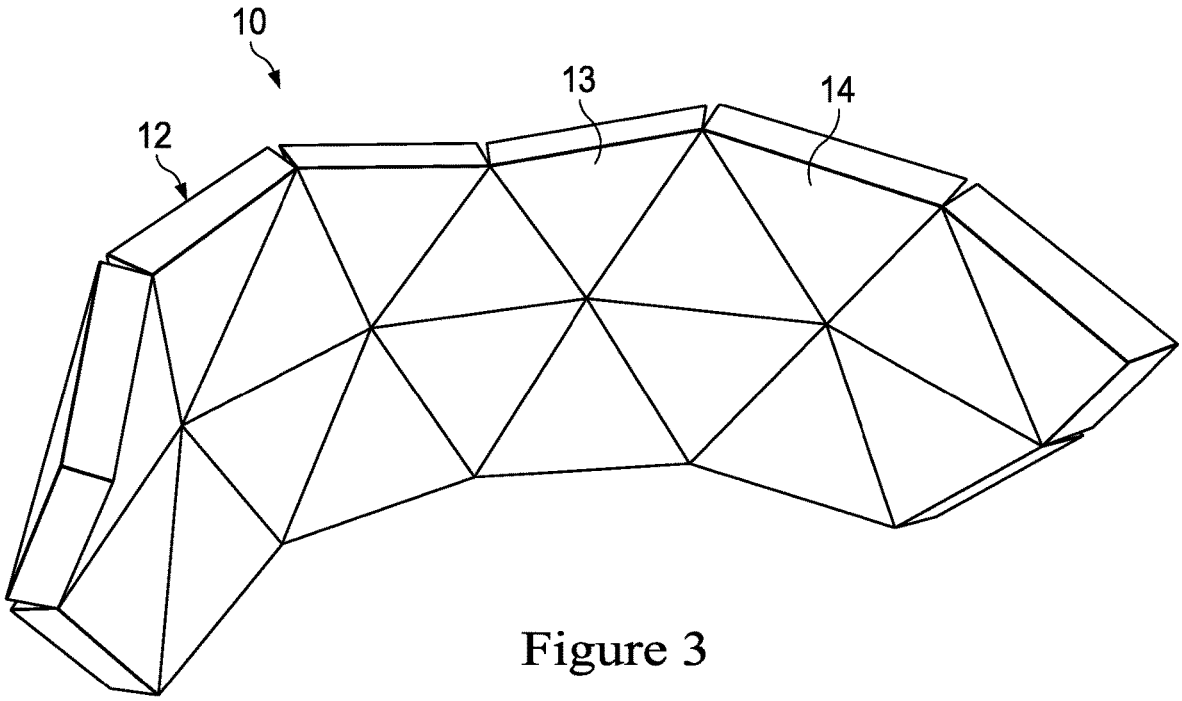
FIG. 3 depicts an example wall structure according to another embodiment.

FIG. 3 refers to a depiction of an inverted, partially-constructed version of the modular wall structure 10 of FIG. 1. As best shown in FIG. 3, each of the first and second triangular units 13, 14 are isosceles triangles. In particular, sides of the first and second triangular units 13, 14 can be referred to as A, B, or C to identify like sides. The first triangular unit 13, for example, includes two A sides, which are equal to each other, and one B side, while the second triangular unit 14 includes two C sides, which are equal to each other, and one B side. Moreover, each abutment of the first and second triangular units 13, 14 involves pairing like sides. For example, an A side of one first triangular unit 13 can be placed in abutment with an A side of another first triangular unit 13. A C side of one second triangular unit 14 can be placed in abutment with a C side of another second triangular unit 14. Additionally, a B side of one first or second triangular unit 13, 14 can be placed in abutment with a B side of another first or second triangular unit 13, 14.

Figure 4:
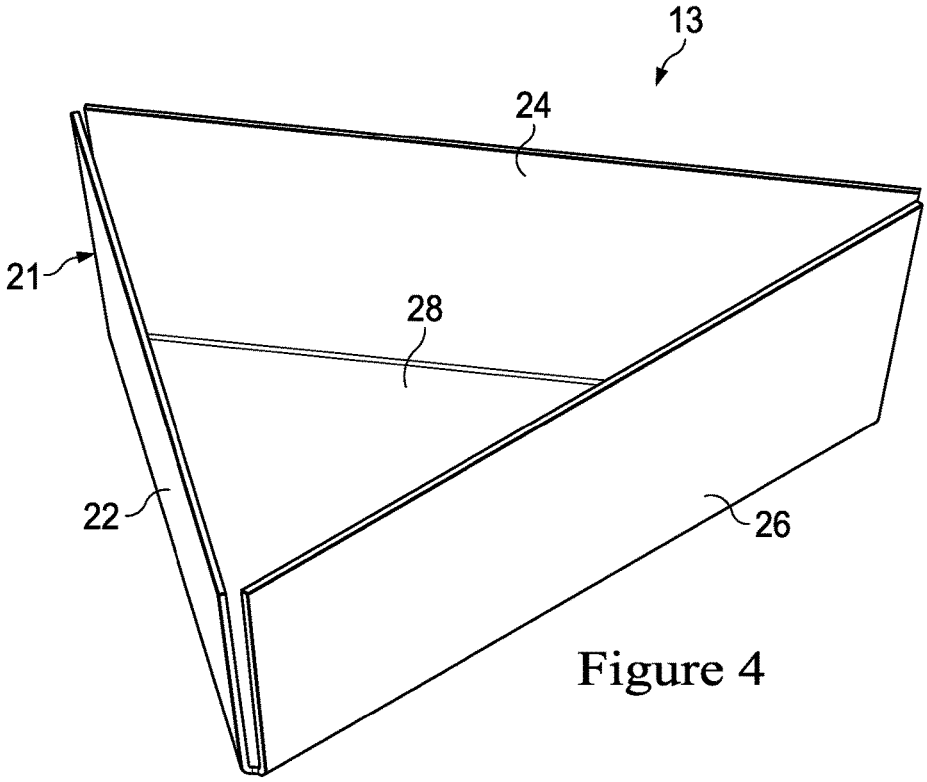
FIG. 4 depicts an isometric view of a first triangular unit of FIG. 1.
Figure 5:
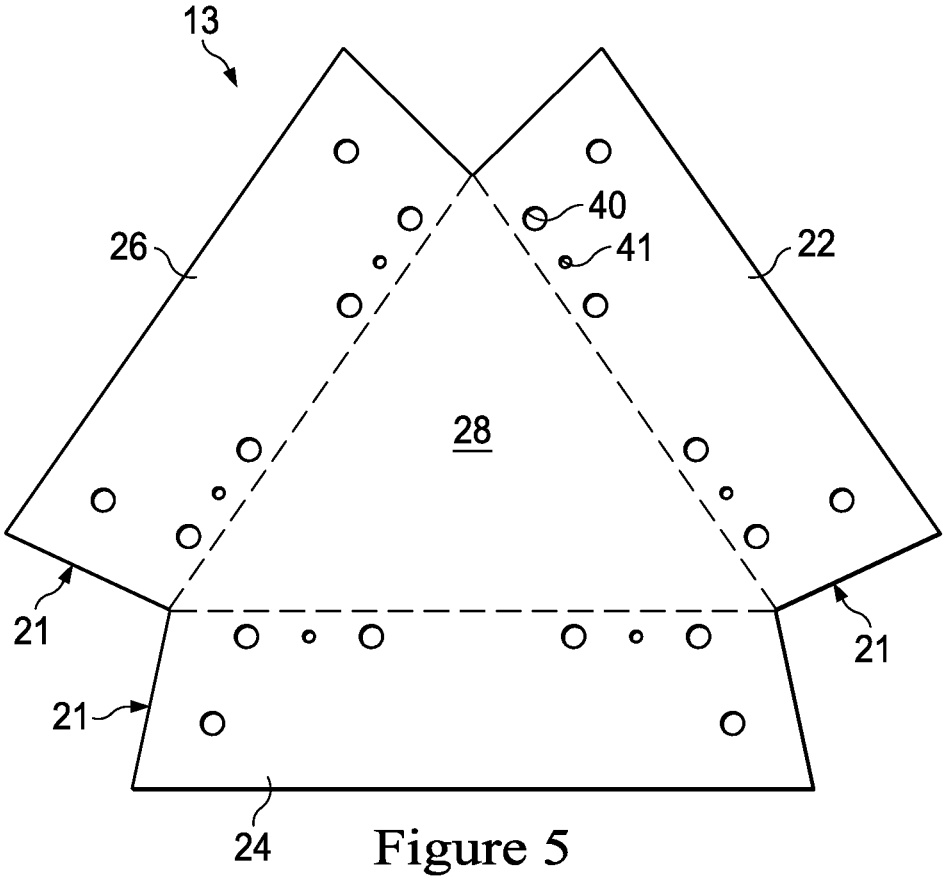
FIG. 5 depicts a plan view of the first triangular unit of FIG. 1, with side panels shown in a coplanar configuration with a face panel.

FIGS. 4 and 5 depict the first triangular unit 13 of FIG. 1. As shown in FIGS. 4 and 5, the first triangular unit 13 includes a frame 21 having a first side panel 22, a second side panel 24, and a third side panel 26, each of which projects outwardly from a face panel 28. The first side panel 22, the second side panel 24, and the third side panel 26 can be pivotable relative to the face panel 28. The first, second, and third side panels 22, 24, 26 of the first triangular units 13 in the modular wall structure 10 of FIG. 1 are configured in a first position or an assembled configuration. As best shown in FIG. 4, in the first position, each of the first, second, and third side panels 22, 24, 26 of the first triangular unit 13 is shown to be rotated upwardly from the face panel 28 about its boundary therewith such that respective ends of the first, second, and third side panels 22, 24, 26 are adjacent to each other. As shown in FIG. 4, in certain embodiments, the first, second, and third side panels 22, 24, 26 can combine with the face panel 28 to define a cavity. However, it will be appreciated that in other embodiments, and as discussed herein, a first triangular unit can further include an additional panel such that the first triangular unit is substantially closed.

As best shown in FIG. 5, the face panel 28 of the first triangular unit 13 is an isosceles triangle. In certain embodiments, the first side panel 22 and the second side panel 24, corresponding to the equivalent sides of the face panel 28, can likewise have the same dimensions. For example, an inner edge for each of the first side panel 22 and the second side panel 24 can correspond to A sides, while an inner edge for the remaining panel, the third side panel 26, can correspond to a B side. In addition to having the same dimensions, a first angle between the first side panel 22 and the face panel 28 can be the same as a second angle between the second side panel 24 and the face panel 28. The third side panel 26 and the face panel 28 can define a third angle. The first, second, and third side panels 22, 24, 26 of the first triangular unit 13 of FIG. 5 are configured in a second position, or an unassembled configuration, where the first, second, and third side panels 22, 24, 26 are shown in a coplanar configuration with the face panel 28. In certain embodiments, the first triangular unit 13 can be collapsible. For example, the first triangular unit 13 can be convertible to the second position, or flattened, for easier storage of the same. However, whether in the first position or the second position, the first triangular unit 13 can be easily stored and/or transported. For example, a plurality of first triangular units 13 in the first position can be nested in each other, while a plurality of first triangular units 13 in the second position can be stacked upon one another. As such, it will be appreciated that in some embodiments, a first triangular unit can be fixed in a first position.

Figure 6:
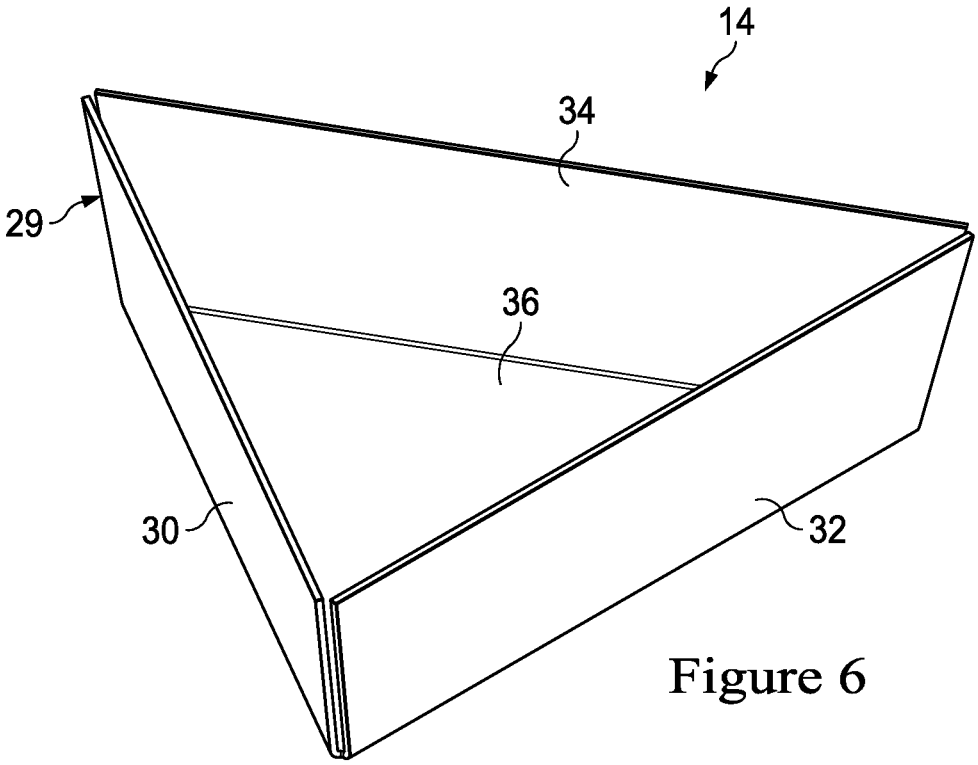
FIG. 6 depicts an isometric view of a second triangular unit of FIG. 1.
Figure 7:
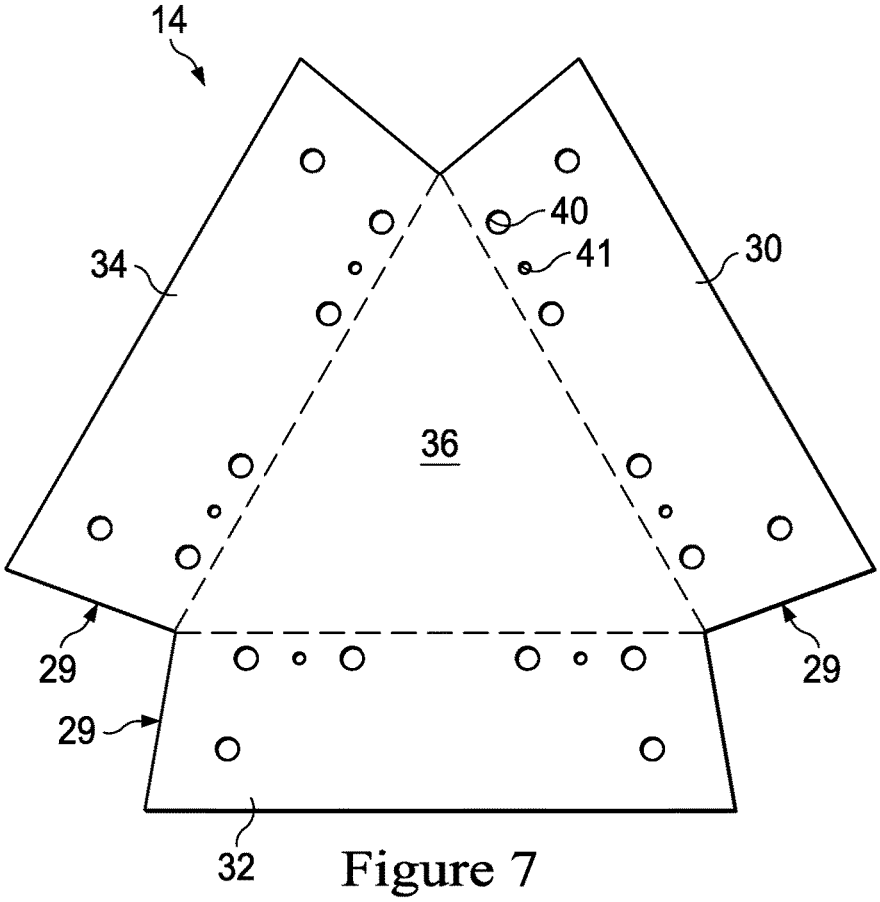
FIG. 7 depicts a plan view of the second triangular unit of FIG. 1, with side panels shown in a coplanar configuration with a face panel.

FIGS. 6 and 7 depict the second triangular unit 14 of FIG. 1. Like the first triangular unit 13, and as shown in FIGS. 6 and 7, the second triangular unit 14 includes a frame 29 having a first side panel 30, a second side panel 32, and a third side panel 34, each of which projects outwardly from a face panel 36. The first side panel 30, the second side panel 32, and the third side panel 34 can be pivotable relative to the face panel 36. The first, second, and third side panels 30, 32, 34 of the second triangular units 14 in the modular wall structure 10 of FIG. 1 are likewise configured in a first position or assembled configuration. As best shown in FIG. 6, in the first position, each of the first, second, and third side panels 30, 32, 34 of the second triangular unit 14 is shown to be rotated upwardly from the face panel 36 about its boundary therewith such that respective ends of the first, second, and third side panels 30, 32, 34 are adjacent to each other. As shown in FIG. 6, the first, second, and third side panels 30, 32, 34 can combine with the face panel 36 to define a cavity. However, it will be appreciated that in other embodiments, and as discussed herein, a second triangular unit can further include an additional panel such that the second triangular unit is substantially closed.

As best shown in FIG. 7, the face panel 36 of the second triangular unit 14 is an isosceles triangle. In certain embodiments, the first side panel 30 and the second side panel 32, corresponding to the equivalent sides of the face panel 34, can likewise have the same dimensions. For example, an inner edge for each of the first side panel 30 and the second side panel 32 can correspond to C sides, while an inner edge for the remaining panel, the third side panel 34, can correspond to another B side. In certain embodiments, the third side panel 26 of the first triangular unit 13 can correspond to the third side panel 34 of the second triangular unit 14, such that dimensions of the respective third side panels 26, 34 can be complementary to each other. In addition to having the same dimensions, a first angle between the first side panel 30 and the face panel 36 can be the same as a second angle between the second side panel 32 and the face panel 36. The third side panel 34 and the face panel 36 can define a third angle. The first, second, and third side panels 30, 32, 34 of the second triangular unit 14 of FIG. 7 are configured in a second position, or an unassembled configuration, where the first, second, and third side panels 30, 32, 34 are shown in a coplanar configuration with the face panel 36. In certain embodiments, the second triangular unit 14 can be collapsible. For example, the second triangular unit 14 can be convertible to the second position, or flattened, for easier storage of the same. However, whether in the first position or the second position, the second triangular unit 14 can be easily stored and/or transported. For example, a plurality of second triangular units 14 in the first position can be nested in each other, while a plurality of second triangular units 14 in the second position can be stacked upon one another. As such, it will be appreciated that in some embodiments, a second triangular unit can be fixed in a first position.

While the respective face panels 28, 36 of the first and second triangular units 13, 14 are shown in FIGS. 4-7 to be isosceles triangles, it will be appreciated that a face panel can have the shape of a different type of triangle or be of any of a variety of other suitable shapes. Similarly, while the respective side panels 22, 24, 26, 30, 32, 34 of the first and second triangular units 13, 14 are shown in FIGS. 4-7 to be quadrilaterals, it will be appreciated that a side panel can be trapezoidal, rectangular, or any of a variety of other suitable shapes. And as described above, respective side panels 22, 24, 26, 30, 32, 34 of the first and second triangular units 13, 14 can cooperate to define cavities, such that the first and second triangular units 13, 14 can be in an open configuration, while in other embodiments, each of the first and second triangular units 13, 14 can further include an additional panel such that the respective first and second triangular units 13, 14 can be in a closed configuration. Accordingly, in certain embodiments, the first and second triangular units 13, 14 can define a truncated triangular pyramid shape, a triangular prism shape, or any of a variety of other suitable triangular-based three-dimensional shapes. However, it will be appreciated that, in other embodiments, a building unit can define any of a variety of other suitable three-dimensional shapes.

Figure 8:
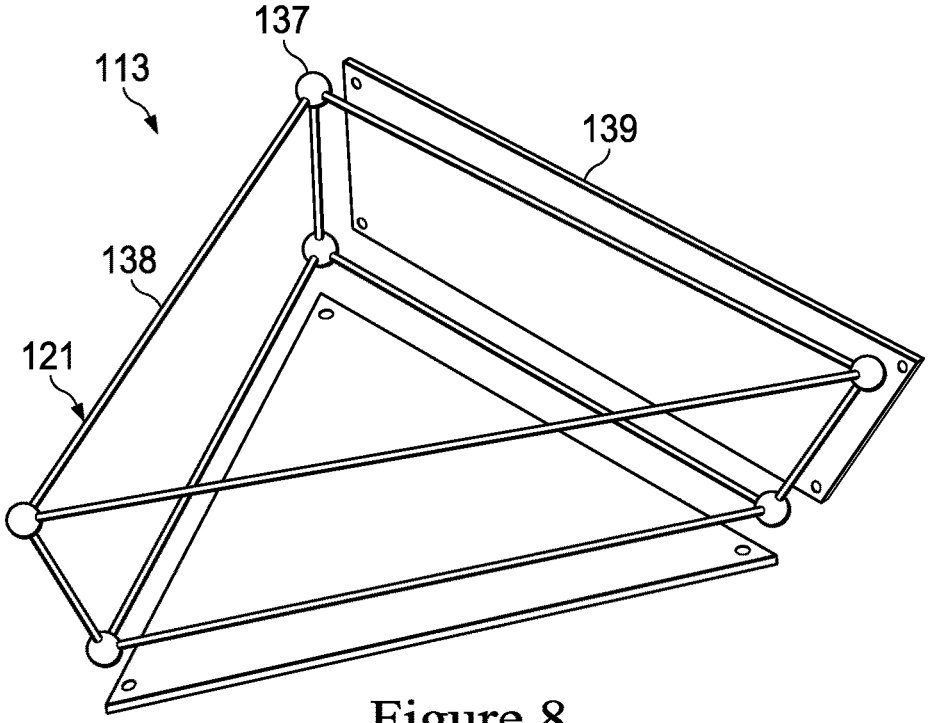
FIG. 8 depicts a ball-and-stick triangular unit according to another embodiment.

While the first and second triangular units 13, 14 are shown in FIGS. 4 and 6, respectively, to have an open configuration, in certain embodiments, the first and second triangular units 13, 14 can have a hollow construction in a closed configuration. For example, in such embodiments, individual first and second triangular units can be monolithically formed as a unitary structure. The sheet (e.g., a cardboard cutout) can include tabs and slots and be configured to be folded into an individual first or second triangular unit. In other embodiments, the first and second triangular units 13, 14 can have a solid construction. In certain embodiments, the first and second triangular units 13, 14 can be lightweight, weighing from about 8 pounds to about 8.5 pounds in certain embodiments. As such, in some embodiments, a modular wall structure 10 could weigh from about 175 pounds to about 185 pounds; from about 170 pounds to about 190 pounds; from about 150 pounds to about 210 pounds; or from about 120 pounds to about 240 pounds. However, even more lightweight building units can be provided. For example, in examples with relatively lightweight materials (e.g., foam-based materials), a modular wall structure could weigh from about 15 pounds to about 75 pounds; from about 20 pounds to about 60 pounds; or from about 25 pounds to about 50 pounds. In another example, and as shown in FIG. 8, the first triangular unit 113 can be formed from a frame 121 of ball couplings 137 and stick connectors 138. Stick connectors 138 can connect to ball couplings 137 by one or more of magnetic forces, snap fit, threading, or by any of a variety of other suitable methods. Further, one or more panels 139 can be attached to the frame 121 by any of the above-described methods to provide for a lightweight building unit. It will be appreciated that in some embodiments, smaller modular wall structures that require fewer or smaller triangular units (e.g. desk-sized applications) can weigh even less than the ranges provided herein.

In certain embodiments, the first and second triangular units 13, 14 can be formed of an aluminum/vinyl sandwich material (e.g., DIBOND®), which can allow for a relatively rigid, durable dry-erase surface and ease of use. It will be appreciated that in certain embodiments, building units, or portions thereof, can be formed of transparent, semi-transparent, translucent, or opaque materials. However, in other embodiments, a building unit can be formed of plastic, bamboo, plywood, cardboard, foamboard, paper, rubber, metal, or any of a variety of other suitable materials. Further, it will be appreciated that a modular wall system can include building units formed of one material along with building units formed of other materials.

In one embodiment, the first and second angles of the first triangular unit 13 can be 97.23° while the third angle of first triangular unit 13 can be 94.10°. Further, the first and second angles of the second triangular unit 14 can be 96.80° while the third angle of first triangular unit 13 can be 97.20°. In certain embodiments, the first, second, and third angles can range from about 70° to about 120°; in certain embodiments, the first, second, and third angles can range from about 80° to about 110°; in certain embodiments, the first, second, and third angles can range from about 90° to about 100°; in certain embodiments, the first, second, and third angles can range from about 92° to about 99°; and in certain embodiments, the first, second, and third angles can range from about 94° to about 98°. However, it will be appreciated that any of the first, second, and third angles can be any of a wide range of suitable values.

In one embodiment, a length of an A side can be 23.05 inches, a length of a B side can be 26.73 inches, and a length of a C side can be 27.32 inches. In such an embodiment, a length of an outer edge for each of a first side panel and a second side panel of a first triangular unit, both of which can correspond to A sides, can be 25.65 inches; a length of an outer edge for each of a first side panel and a second side panel of a second triangular unit, both of which can correspond to C sides, can be 30.40 inches; and a length of an outer edge for third side panels of each of the first and second triangular units, both of which can correspond to B sides, can be 29.73 inches.

In certain embodiments, the length of the A side can be from about 12 inches to about 36 inches; from about 18 inches to about 30 inches; or from about 21 inches to about 25 inches. In certain embodiments, the length of the B side can be from about 12 inches to about 40 inches; from about 20 inches to about 32 inches; or from about 25 inches to about 29 inches. In certain embodiments, the length of the C side can be from about 12 inches to about 40 inches; from about 20 inches to about 32 inches; or from about 25 inches to about 29 inches. And in certain embodiments, the length of the outer edge of the side panels for each of the first and second triangular units can be from about 12 inches to about 44 inches; from about 16 inches to about 40 inches; or from about 20 inches to about 36 inches.

In one embodiment, a width of each of a first side panel and a second side panel of the first triangular unit (i.e. distance between the inner and outer edges), both of which can correspond to A sides, can be 7.89 inches; a width of each of a first side panel and a second side panel of the second triangular unit, both of which can correspond to C sides, can be 7.82 inches; and a width of third side panels of each of the first and second triangular units, both of which can correspond to B sides, can be 7.85 inches. In certain embodiments, the width of the side panels for each of the first and second triangular units can be from about 2 inches to about 15 inches; from about 4 inches to about 12 inches; or from about 6 inches to about 9 inches.

The angles and dimensions provided for each of the respective first, second, and third side panels 22, 24, 26, 30, 32, 34 and the face panels 28, 36 can dictate the degree of curvature of the modular wall structure 10. In addition to the first, second, and third angles, adjacent face panels 28, 36 can define dihedral angles. For example, in certain embodiments, adjacent face panels 28 of the first triangular units 13 forming the pentagon-shaped portion 19 of the modular wall structure 10 can define dihedral angles of 180° or less. Similarly, in certain embodiments, adjacent face panels 36 of the second triangular units 14 forming the hexagon-shaped portions 20 of the modular wall structure 10 can also define dihedral angles of 180° or less.

While the pentagon-shaped portion 19 and the hexagon-shaped portions 20 of the modular wall structure 10 are shown in FIG. 1 to be a combination of the first and second triangular units 13, 14, respectively, it will be appreciated that each of a pentagon-shaped portion and a hexagon-shaped portion can be provided as an integral unit. Moreover, other shapes, such as a kite, can also be provided as an integral unit.

The building units 12 of the modular wall structure 10 can be secured to each other by any of a variety of suitable methods. For example, in certain embodiments, each of the plurality of building units 12 can include one or more magnets, such that the building units 12 can be held together by magnetic forces. In particular, each of the first, second, and third side panels 22, 24, 26, 30, 32, 34 of the frames 21, 29 of the first and second triangular units 13, 14, respectively, can include magnets therein. FIGS. 5 and 7, for example, depict locations 40 at which magnets can be provided. However, it will be appreciated that magnets used in the modular wall structure can be exposed, removable, and/or embedded within a panel.

In certain embodiments, magnet configurations can be provided with alternating polarities along the length of the first, second, and third side panels 22, 24, 26, 30, 32, 34, around a perimeter of the face panels 28, 36 of the first and second triangular units 13, 14. For example, a first end of a side panel corresponding to a first A side (e.g., the first side panel 22) can have a north pole of a magnet and a second end of the side panel corresponding to the first A side (e.g., the first side panel 22) can have a south pole of a magnet. Further, a first end of a side panel corresponding to a second A side (e.g., the second side panel 24) can have a south pole of a magnet and a second end of the side panel corresponding to the second A side (e.g., the second side panel 24) can have a north pole of a magnet, such that when respective first ends and second ends of the side panels corresponding to the first and second A sides (e.g., the first and second side panels 22, 24) are brought into alignment, the respective north and south poles (i.e., opposite poles) will also be in alignment, and the magnetic forces therebetween can facilitate the securement of the side panels to each other. In certain embodiments, the same principles can be applied to side panels corresponding to B sides and C sides. However, it will be appreciated that such principles can be further extended to side panels of other building units.

In addition to or in place of magnets, any of a variety of suitable fixtures can be employed to secure connections between the building units 12 of the modular wall structure 10. For example, such fixtures can include, but are not limited to, pins, bolts, U-channels, clamps (e.g., spring clamps), and other types of fasteners. For example, FIGS. 5 and 7 depict holes 41 through which bolts can be provided to secure side panels to each other. Any of a variety of suitable bolts can be employed to secure connections between the building units 12 of the modular wall structure 10, including ball bolts, which can be tightened and loosened by hand.

Figure 9:
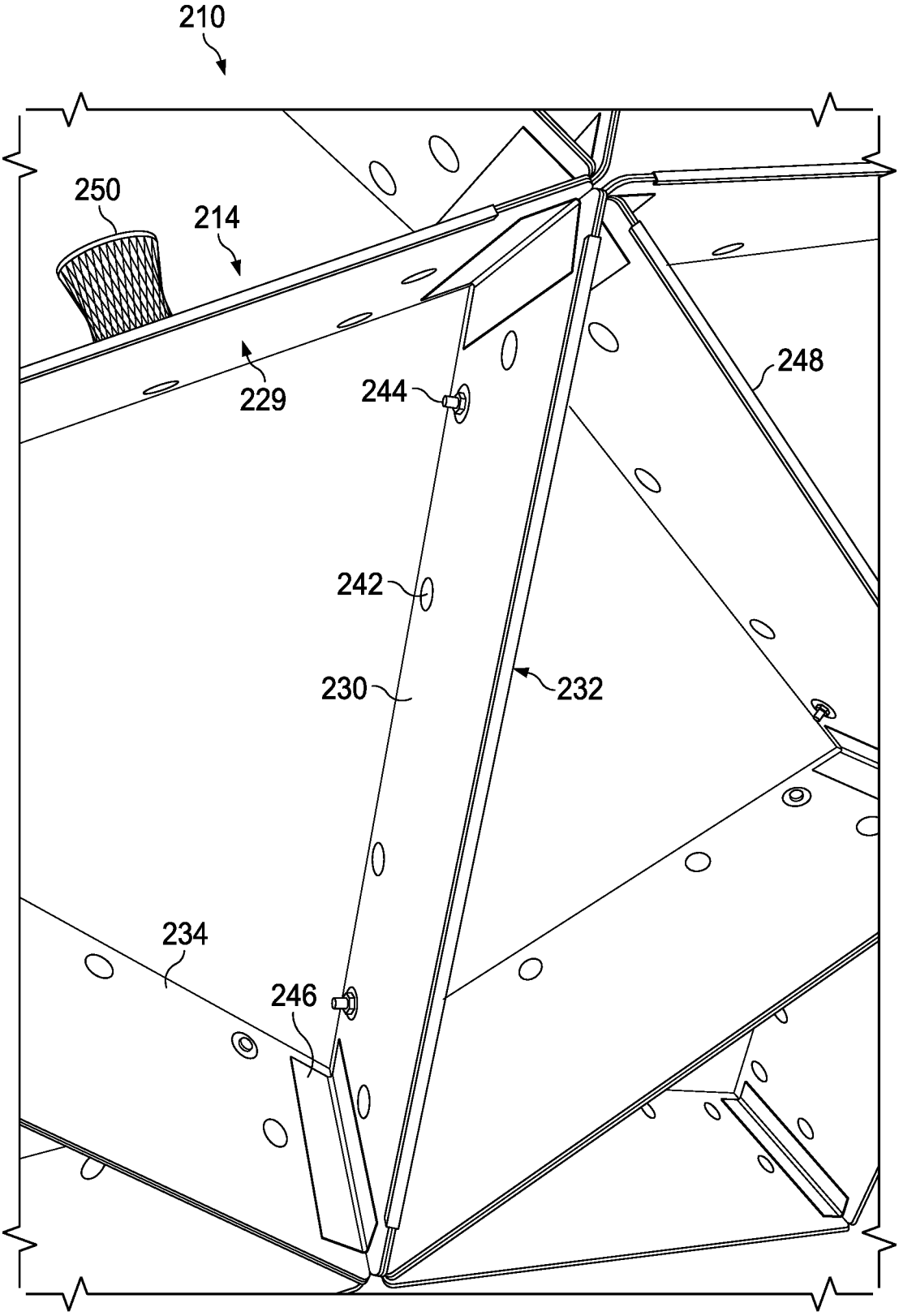
FIG. 9 depicts a rear view of an example wall structure according to another embodiment, with building units being connected with a combination of magnets, bolts, bent aluminum strips, and U-channels.

FIG. 9 depicts a rear view of another embodiment of the modular wall structure 210, where the frames 221, 229 of respective first and second triangular units 213, 214 are secured to each other by a combination of magnets 242, bolts 244, bent aluminum strips 246, and U-channels 248. As shown in FIG. 9, a rear portion of the modular wall structure 210 can provide storage for various items. For example, the side panels (e.g., 230, 232) of adjacent second triangular units 214, connected by the combination of magnets 242, bolts 244, bent aluminum strips 246, and U-channels 248, can be used as shelving. Moreover, the magnets 242 can assist in this capacity, particularly where stored items (e.g., cup 250) include a magnetic component. As further shown in FIG. 9, the magnets 242 and bolts 244 may be incorporated on the side panels (e.g., 230, 232) near the inner edges thereof, closer to the face panels 236. Further, the U-channels 248 can be applied at the outer edges of the side panels (e.g., 230, 232) in order to clamp the same together. As understood from FIG. 9, the U-channels 248 can be elongated fixtures having a top portion and two side portions extending therefrom which can define a slot for receiving two side panels. For embodiments where for larger, deeper side panels are employed, the multi-fixture configuration shown in FIG. 9 can be effective to provide a sufficient securing force throughout the length and width of adjoining side panels (e.g., 230, 232). The bent aluminum strips 246 can be used to provide structural integrity by connecting adjacent ends of side panels (230, 234). As shown in FIG. 9, one portion of the aluminum strip 246 is attached to the first side panel 230 of the second triangular unit 214, while another portion is attached to the third side panel 234 of the second triangular unit 214. It will be appreciated that an attachment between a bent aluminum strip and a side panel can be releasable and can be by any of a variety of methods.

Figure 10:
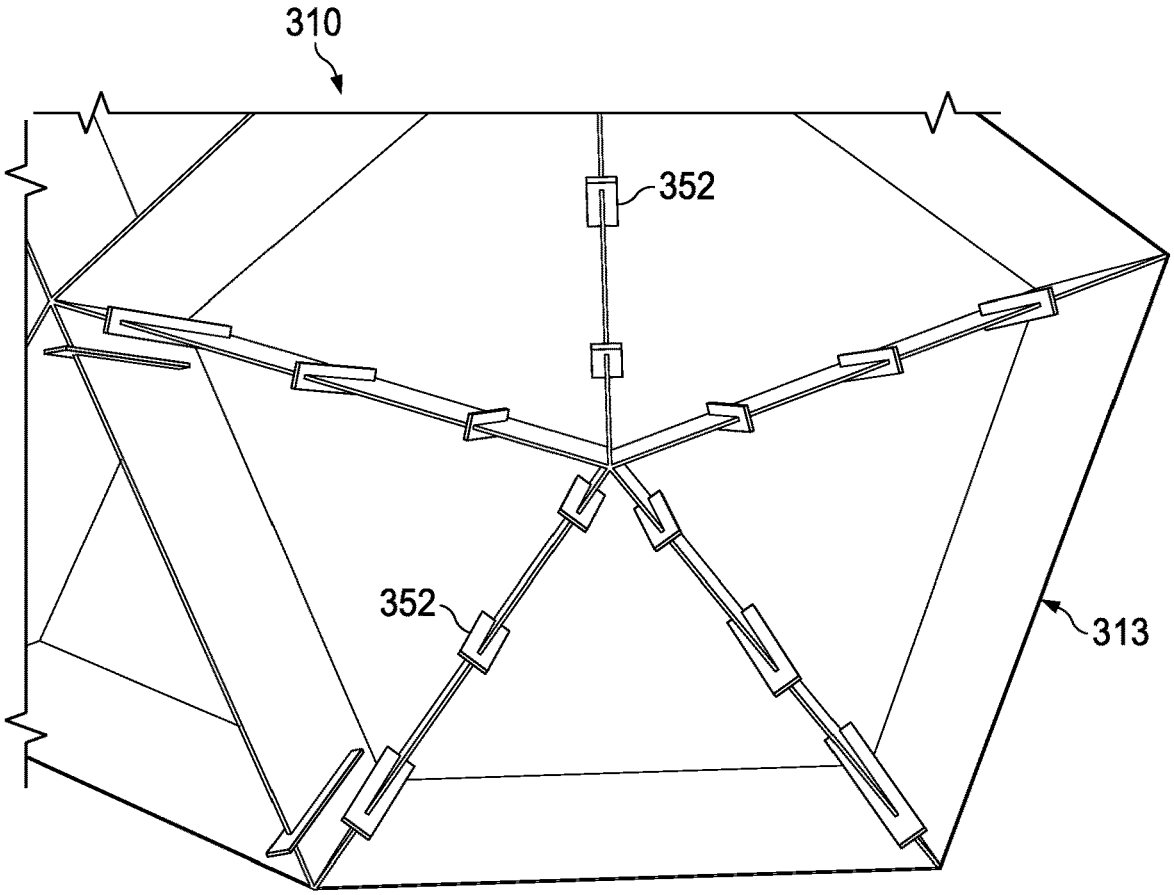
FIG. 10 depicts a rear view of an example wall structure according to another embodiment, with building units being connected with pins.

In other embodiments, pins can be used in addition to or in place of U-channels. For example, FIG. 10 depicts a rear view of another embodiment of the modular wall structure 310, where the first triangular units 313 are secured to each other by a plurality of pins 352. In particular, the pins 352 can be applied at the outer edges of the side panels (e.g., 322, 324) in order to clamp the same together. FIG. 10 depicts a more detailed view of the pins 352, each of which can be a fixture having a top portion and two elongated side portions extending therefrom which can define a slot for receiving two side panels. As with U-channels, pins 352 can be employed where larger, deeper side panels are involved. While some of the above-described fixtures are shown in certain figures to be used with a first triangular unit or a second triangular unit, it will be appreciated that, unless otherwise noted, any of the fixtures described herein can be used with either of the first or second triangular units or any other building unit.

Figure 11A:
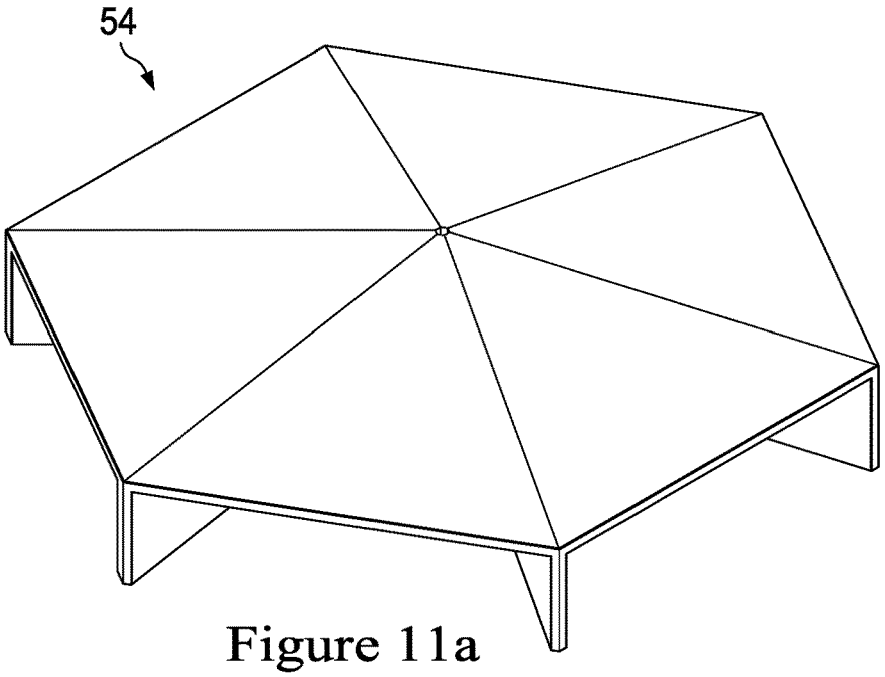
FIGS. 11*a* and 11*b* depict isometric and bottom views, respectively, of a connector.
Figure 11B:
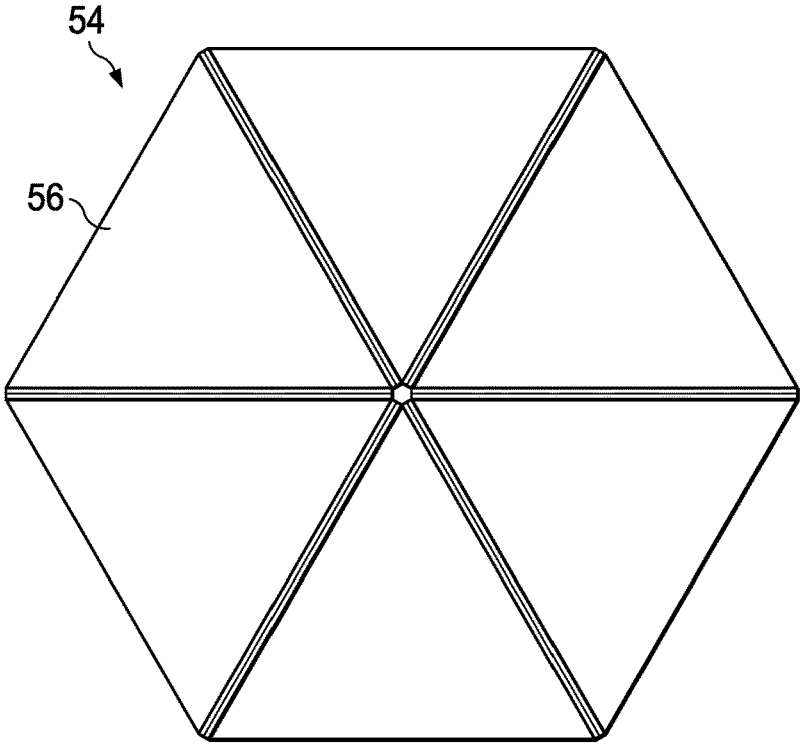

In certain embodiments, various connector fixtures can be used to secure multiple side panels by grasping corners of the outer edges thereof. In one example, a connector 54 can be used at a center of a rear portion of the hexagon-shaped portion 18 of the modular wall structure 10. Referring to FIGS. 11*a* and 11*b*, the connector 54 can include six pairs of tabs 56, where each of the pairs of tabs 56 defines a channel, such that the pairs of tabs 56 can combine to secure the corners of two side panels (e.g., 230, 232) for each of six second triangular units (e.g., 214) within such channels. However, while the connector 54 depicted in FIGS. 11*a* and 11*b* is shown to include six pairs of tabs 56 defining channels that equally spaced about a central axis, it will be appreciated that a connector may have any suitable number of tabs in any of a variety of spacing configurations to accommodate securement of any of a variety of building unit configurations. Further, it will be understood that such connectors can be formed from metal, plastic, rubber, or any of a variety of suitable materials.

The fixtures and configurations that can be used to facilitate connections between the building units 12 of the modular wall structure 10 are not limited to those depicted in FIGS. 9-11. It will be understood that any of a variety of configurations using the above-described fixtures can be employed to effect such securement. For example, different configurations can be employed for the building units 12 used in the top row 19 and the building units 12 forming the bottom row 20. As the first and second triangular units 13, 14 of the top row 19 may be temporarily distributed and subsequently reattached to the modular wall structure 10, in certain embodiments, connections between the first and second triangular units 13, 14 of the top row 19 can be of a more temporary nature than those between the first and second triangular units 13, 14 of the bottom row 20. In one example, each of the side panels of the first and second triangular units 13, 14 used in the bottom row 20 can be held together by more fixtures (e.g., magnets, bolts) than an amount used to secure each of the side panels of the first and second triangular units 13, 14 of the top row 19. Alternatively, each of the side panels of the first and second triangular units 13, 14 used in the bottom row 20 can be held together by stronger fixtures (e.g., stronger and/or larger magnets) than those used to secure each of the side panels of the first and second triangular units 13, 14 of the top row 19.

Figure 12:
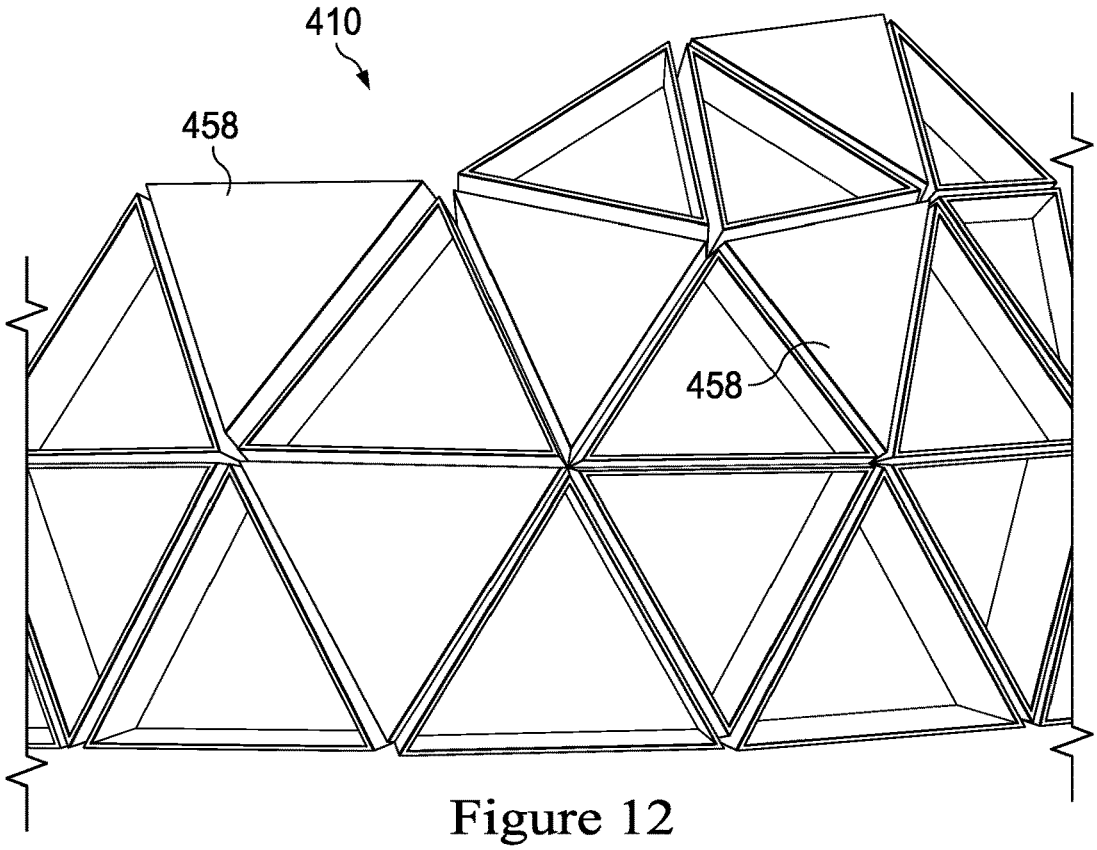
FIG. 12 depicts an example wall structure according to another embodiment, where sections of a rear portion of the modular wall structure are concealed by cover panels.
Figure 13:
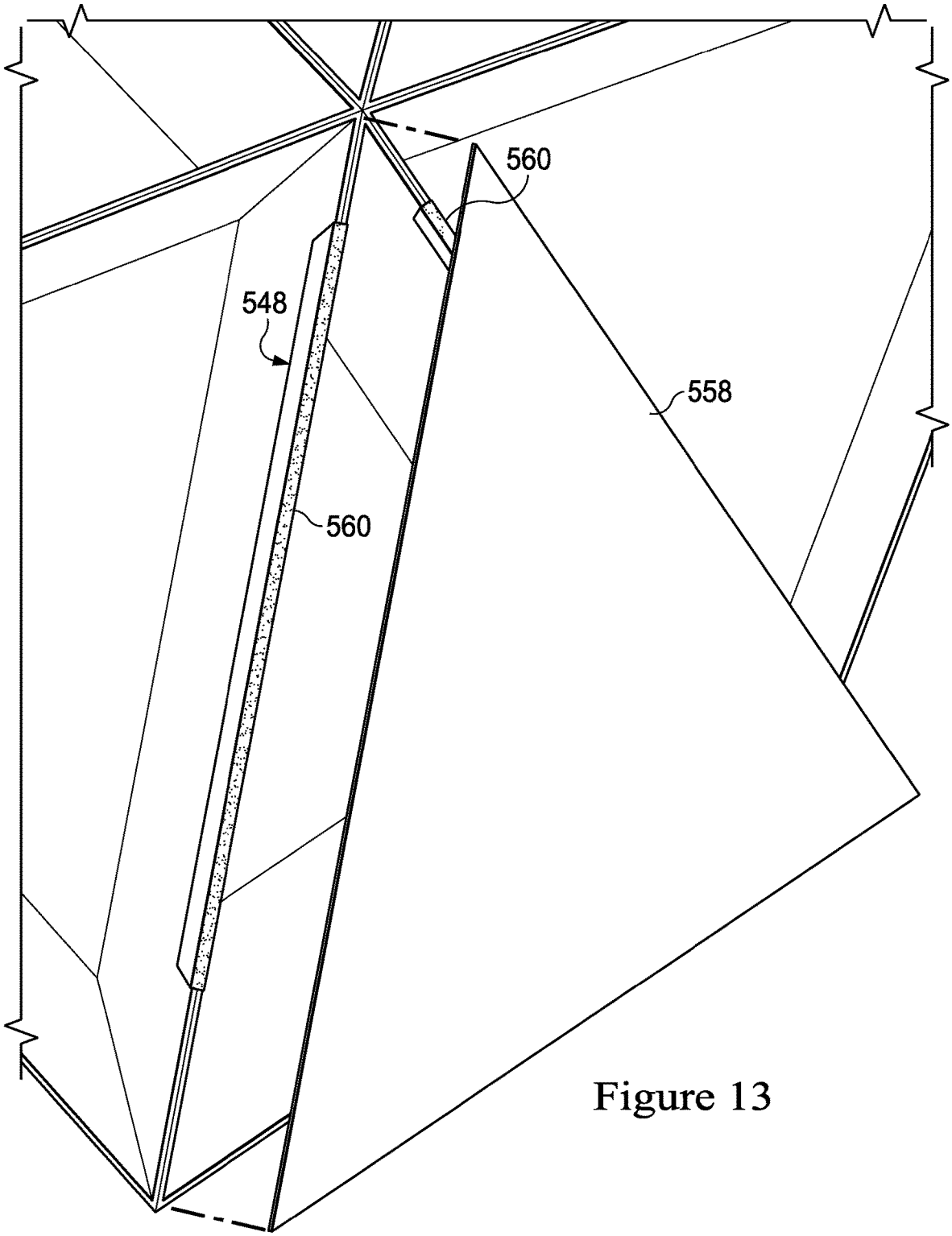
FIG. 13 depicts an isometric view of a cover panel according to another embodiment.
Figure 14:
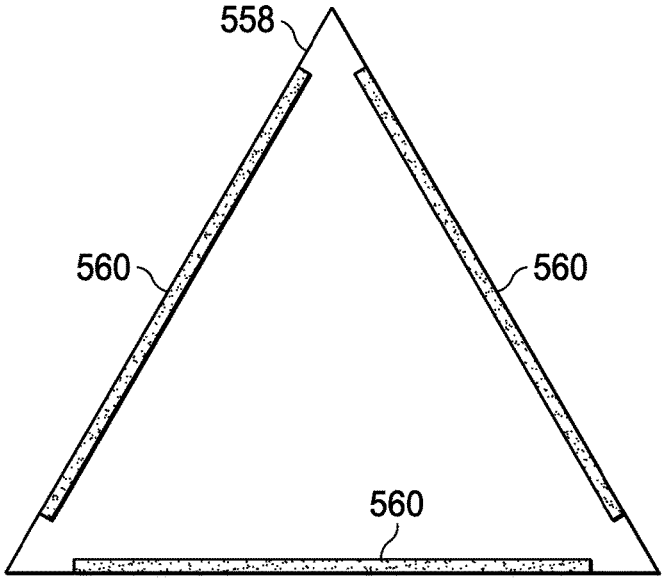
FIG. 14 depicts a rear view of the cover panel of FIG. 13.

Referring back to FIGS. 9 and 10, it is shown that in certain embodiments, the rear portion of the modular wall structure 210, 310 can remain open. In other embodiments, and as shown in FIG. 12, the rear portion the modular wall structure 410, or sections thereof, can be concealed by one of more cover panels 458 or rear face panel. For example, one or more of the first and second triangular units 413, 414 can further include a cover panel 458, selectively attachable thereto, such that each of such first and second triangular units can be substantially closed and at least a section of the rear portion of the modular wall structure 410 can be concealed. FIGS. 13 and 14 show additional detail as to how a cover panel can be applied to a modular wall structure according to one embodiment. As shown in FIG. 13, hook-and-loop fasteners 560 (e.g., VELCRO®) can be used to attach the cover panel 558 to the modular wall structure 510, such that one portion of the hook-and-loop fasteners 560 can be applied to the top portion of the U-channels 548, and as best shown in FIG. 14, another portion of the hook-and-loop fasteners 560 can be applied to portions of a perimeter on a rear side of the cover panel 558. In such embodiments, the cover panel 558 can extend over about half of a width of the top portion of the U-channels 548 to allow for attachment of a cover panel on the adjacent second triangular unit 514. It will be appreciated, however, that a cover panel can be applied to a modular wall structure by using magnets, bolts, and/or U-channels or through any of a variety of other suitable methods. Additionally, while the cover panel 558 of FIG. 13 is shown to be applied to the U-channel 548, it will be appreciated that a cover panel can be applied directly or indirectly to a building unit, particularly where side panels do not employ U-channels and/or where a frame includes side panels having a thickness that allows for the same. Alternatively, a rear face panel can be monolithically formed within an individual first or second triangular unit as a unitary structure. It will be appreciated that a cover panel or rear face panel, as with other portions of the first and second triangular units, can be transparent, semi-transparent, translucent, or opaque. Further, it will be appreciated that a cover panel can be formed from glass, aluminum/vinyl sandwich material, plastic, bamboo, plywood, cardboard, foamboard, paper, rubber, metal, or any of a variety of other suitable materials.

Figure 15:
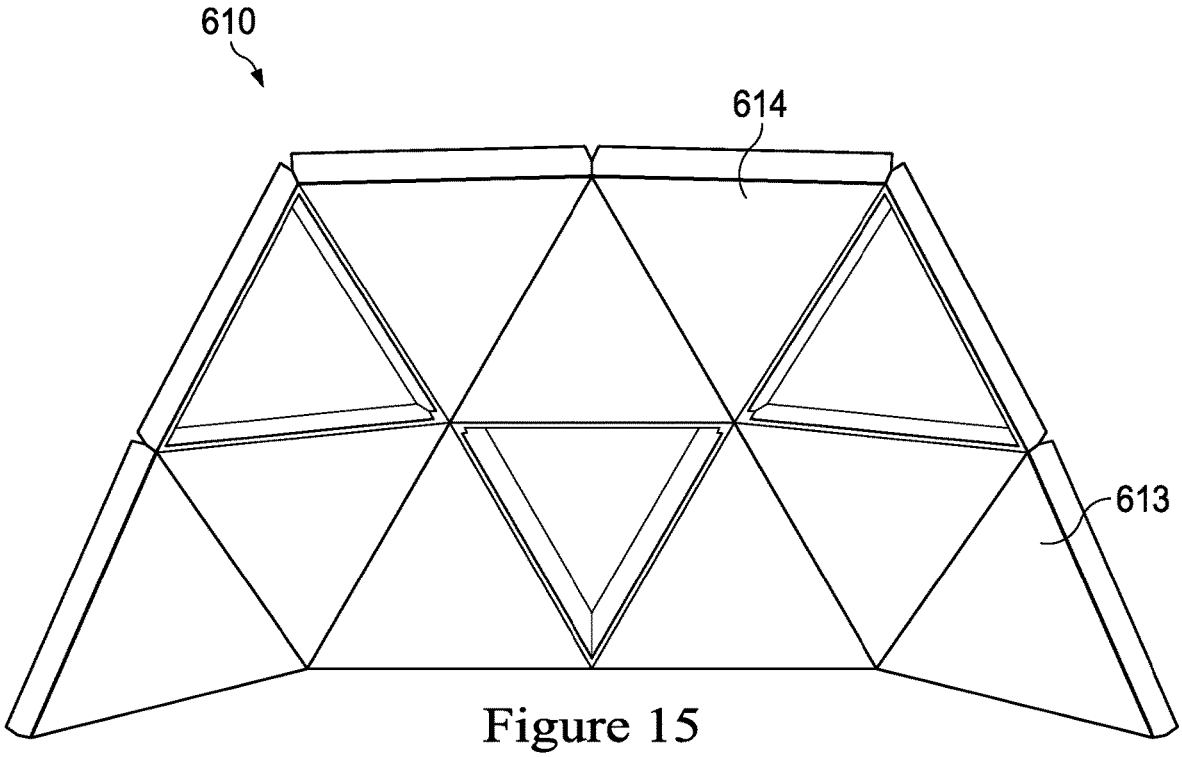
FIG. 15 depicts an example wall structure according to another embodiment, where first and second triangular units face in different directions.
Figure 16:
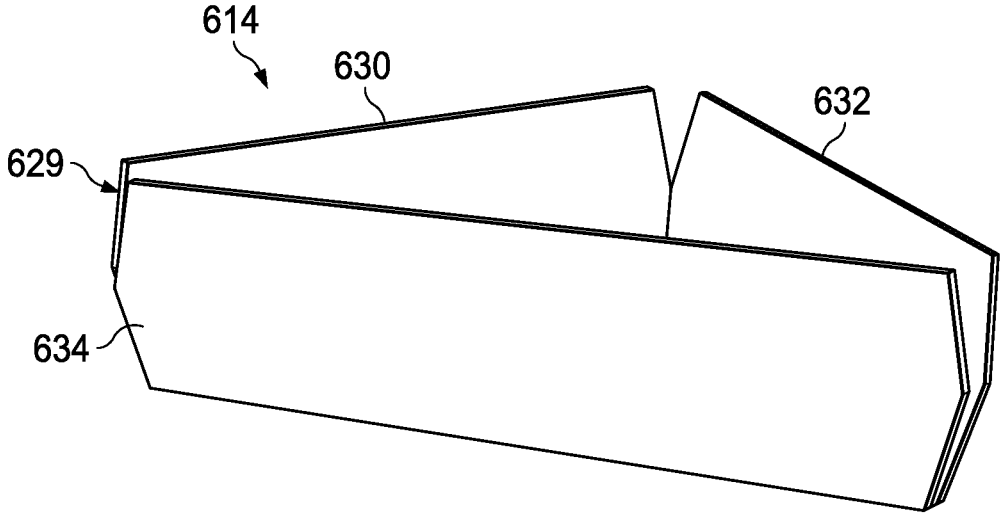
FIG. 16 depicts an isometric view of a second triangular unit of FIG. 15.

While several embodiments of modular wall structures have been depicted to have all first and second triangular units in a forward-facing direction, thereby defining a front portion (e.g., FIGS. 1 and 3) and a rear portion (e.g., FIGS. 9 and 10), it will be appreciated that, in other embodiments, the modular wall structure 610 can be configured to have reversible first and second triangular units 613, 614. For example, the modular wall structure 610 can be configured to have first and second triangular units 613, 614 facing in different directions, as shown, for example, in FIG. 15. In some of such embodiments, as shown in FIG. 16, the side panels (e.g., 630, 632, 634) of the frame 629 can be configured to minimize interference from corners of outer edges to facilitate securement of first and second triangular units facing in different directions. For example, and as shown in FIG. 16, ends of the side panels can be formed with point. In some of such embodiments, the point can be equidistant from the inner edge and the outer edge. It will be appreciated that gaps in a modular wall structure resulting from use of triangular units having such truncated corners can be covered by a small panel or facet. Providing first and second triangular units 613, 614 that can face in different directions can further enhance the modular nature of the wall structure 610. For example, the first and second triangular units 613, 614 can form a modular wall structure 610 that is flat or substantially flat. It will be appreciated that in other examples, first and second triangular units can form modular wall structures including a variety of complex, geodesic curves. In certain embodiments, securement of the first and second triangular units 613, 614 to each other can be facilitated by any of a variety of suitable fixtures described above. In a preferred embodiment, the first and second triangular units 613, 614 are secured to each other by a plurality of bolts through the side panels.

Figure 17:
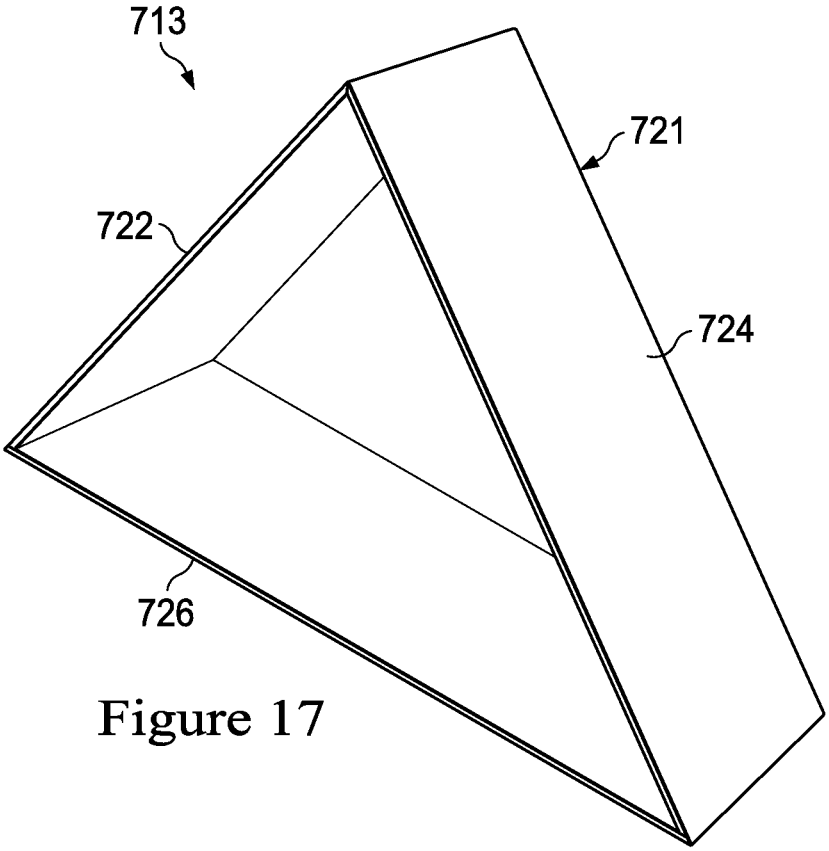
FIG. 17 depicts an isometric view of a first triangular unit, according to another embodiment, with three side panels joined together.
Figure 18:
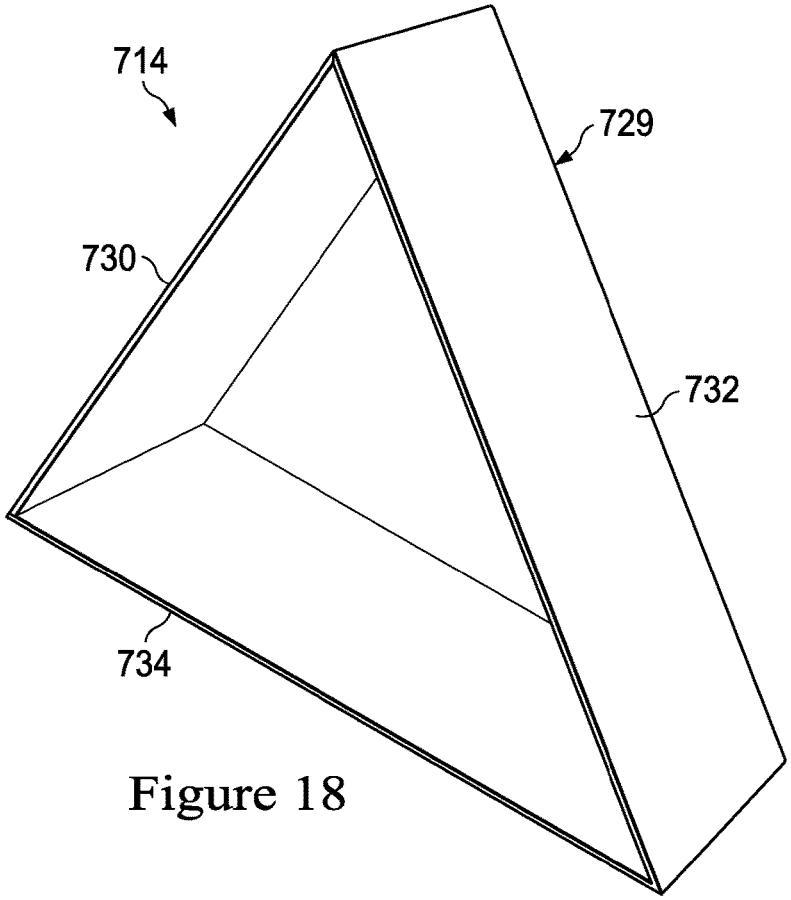
FIG. 18 depicts an isometric view of a first triangular unit, according to another embodiment, with three side panels joined together.

FIGS. 17 and 18 depict first and second triangular units 713, 714 according to another embodiment. As shown in FIG. 17, the first triangular unit 713 is formed from the frame 721 including the first, second, and third side panels 722, 724, 726. As shown in FIG. 18, the second triangular unit 714 is formed from the frame 729 including the first, second, and third side panels 730, 732, 734. Unlike the first and second triangular units 13, 14 shown in FIGS. 4-7, inclusion of one or more face panels is optional. In such embodiments, the side panels 722, 724, 726 of the first triangular unit 713, for example, can be joined to each other to form the same. The side panels of the first and second triangular units can be permanently connected or releasably connectable, for example, at respective ends of each side panel. The joints between adjacent side panels can be mitered, butt joints, or any of a variety of suitable connections. In certain embodiments, such first and second triangular units are readily collapsible, for storage or transport, where one or more of the connections between side panels can remain intact. One or more of a face panel or a cover panel can optionally be attached to such first and second triangular units as described herein. It will be appreciated that the first and second triangular units of FIGS. 17 and 18 can include the dimensions described for the other first and second triangular embodiments described herein and be formed of any of the materials described for the other first and second triangular embodiments described herein. Furthermore, while many of the figures depict modular wall structures with similar first and second triangular units, it will be appreciated that the various first and second triangular units as described herein can be used in association with each other.

Figure 19:
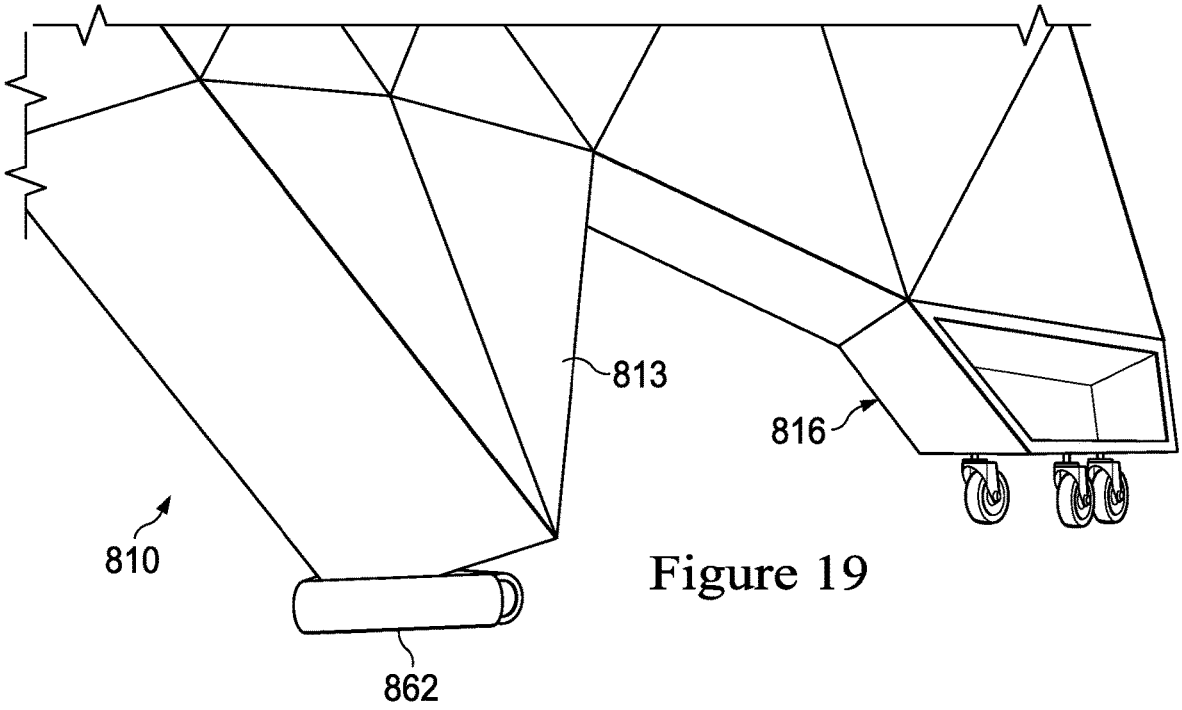
FIG. 19 depicts an isometric view of a center base unit and a wheeled end base unit with an example wall structure according to another embodiment.

The wheeled center base unit 15, as shown in FIGS. 1 and 2 can define a gap in which two first triangular units 13, for example, can sit and be secured, in part, by the weight of the modular wall structure 10. However, it will be appreciated that a modular wall structure could also be secured to a wheeled center base unit by magnets, bolts, or by any of a variety of other suitable methods of connection. Alternatively, and as shown in FIG. 19, the modular wall structure 810 can further include a center base unit 862, which can sit on the ground or floor surface, to further facilitate the stability of the modular wall structure 810. Like the wheeled center base unit 15 shown in FIGS. 1 and 2, the center base unit 862, as shown in FIG. 19, can define a gap in which two first triangular units 813, for example, can sit and be secured, in part, by the weight of the modular wall structure 810.

The modular wall structure can utilize other embodiments of center base units in addition to or in place of the embodiment depicted in FIG. 19. For example, in another embodiment, a center base unit can include a substantially X-shaped block that can provide a seat for two first triangular units, for example, to sit and be secured, in part, by the weight of a modular wall structure. In another embodiment, a center base unit can define a gap in which two first triangular units, for example, can be secured, in part, by the weight of a modular wall structure, but the modular wall structure can remain in contact with the ground or floor surface, while the center base sits above the ground. Similarly, it will be appreciated that a modular wall structure could also be secured to any center base unit by magnets, bolts, or by any of a variety of other suitable methods of connection.

Referring back to FIG. 19, a more detailed depiction of the wheeled end base unit of FIG. 1 is shown. In certain embodiments, the wheeled end base units 816 can be secured to one or more building units 812 by one or more bolts. However, it will be appreciated that a modular wall structure could be secured to a wheeled end base unit by magnets or any of a variety of other suitable methods of connection. As shown in FIG. 19, in certain embodiments, a top surface of the wheeled end base unit 816 can be angled relative to a ground or floor surface to facilitate the stability of the modular wall structure 810 and enhance workability thereon. In certain embodiments, a modular wall structure can include an end base unit, which can be an essentially non-wheeled version of the wheeled end base unit 816 of FIG. 19. In such embodiments, the end base unit can be secured to the modular wall structure by a combination of magnets and bolts. In certain embodiments, the end base unit can further include a power cord.

In some embodiments, the modular wall structure can be wired for power, such that the modular wall structure is a powered work station. The modular wall structure can include a battery, a power cord to connect to a wall outlet, and/or include or connect to any of a variety of other power sources, which can allow for a wide range of functionality. For example, one or more building units can include a computer. In some embodiments, a first triangular unit can include a tablet embedded in the face panel, such that a screen on a front side of the tablet is accessible to a user. It will be appreciated, however, that a computer can be included in a second triangular unit or any other suitable building unit. In certain embodiments, the modular wall structure can include one or more electrical outlets, USB ports, charging pads, or any of a variety of other suitable ports to activate, charge, or otherwise access electronic devices. For example, in an embodiment including an embedded tablet such as that described above, USB ports can be provided on a rear side of the tablet. In certain embodiments, one or more building units of the modular wall structure can have a light-up display.

Electricity from a power source can be distributed to one or more building units in any of a variety of known methods. In certain embodiments, two or more building units can be connected to each other by external wiring extending from unit to unit. Alternatively, two or more building units can be connected to each other by wiring embedded within portions of each building unit. In other embodiments, each of the building units of the modular wall structures can include an integrated circuitry. In some of such embodiments, the integrated circuitry can include magnets. In particular, such magnets can include those which being employed to facilitate the securement of building units to each other. In certain embodiments, an otherwise non-powered modular wall structure can be activated as a powered modular wall structure by the implementation of one or more powered building units. In some of such embodiments, the powered building unit could include a power source (e.g., battery) or access to a power source (e.g., power cord). In one example, the powered building unit can can include a tablet as described herein. In another embodiment, the implementation of one or more powered base units, as described above, can be used for such activation.

A modular wall structure computer system in accordance with the present disclosure can be accessed via any suitable technique, such as a web-browser such as SAFARI, OPERA, GOOGLE CHROME, INTERNET EXPLORER, or the like executing on a client device. In some embodiments, the systems and methods described herein can be a web-based application or a stand-alone executable. Additionally, in some embodiments, the systems and methods described herein can integrate with other systems of various types. Any suitable client device can be used to access, or execute, the modular wall structure computing system, such as laptop computers, desktop computers, smart phones, tablet computers, gaming system, and the like.

Interaction with the modular wall structure computer system may include, without limitation, keyboard entry, writing from pen, stylus, finger, or the like, with a computer mouse, or other forms of input (voice recognition, etc.). The modular wall structure computer system may be presented on a tablet, desktop, phone, board, or paper. In one embodiment, the user may interact with a modular wall structure computer system by writing with a smart pen on a portion of a building unit (e.g., first triangular unit), normal paper, modified paper, or a hard flat surface of their preference. In this embodiment, the user may receive real-time feedback, or at least near real-time feedback, or may synchronize with a modular wall structure computer system at a later date. The modular wall structure computer system can be a personal computer, one or multiple computers in server-type system.

In general, it will be apparent to one of ordinary skill in the art that at least some of the embodiments described herein can be implemented in many different embodiments of software, firmware, and/or hardware. The software and firmware code can be executed by a processor or any other similar computing device. The software code or specialized control hardware that can be used to implement embodiments is not limiting. For example, embodiments described herein can be implemented in computer software using any suitable computer software language type, using, for example, conventional or object-oriented techniques. Such software can be stored on any type of suitable computer-readable medium or media, such as, for example, a magnetic or optical storage medium. The operation and behavior of the embodiments can be described without specific reference to specific software code or specialized hardware components. The absence of such specific references is feasible, because it is clearly understood that artisans of ordinary skill would be able to design software and control hardware to implement the embodiments based on the present description with no more than reasonable effort and without undue experimentation.

Moreover, the processes described herein can be executed by programmable equipment, such as computers or computer systems and/or processors. Software that can cause programmable equipment to execute processes can be stored in any storage device, such as, for example, a computer system (nonvolatile) memory, an optical disk, magnetic tape, or magnetic disk. Furthermore, at least some of the processes can be programmed when the computer system is manufactured or stored on various types of computer-readable media.

It can also be appreciated that certain portions of the processes described herein can be performed using instructions stored on a computer-readable medium or media that direct a computer system to perform the process steps. A computer-readable medium can include, for example, memory devices such as diskettes, compact discs (CDs), digital versatile discs (DVDs), optical disk drives, or hard disk drives. A computer-readable medium can also include memory storage that is physical, virtual, permanent, temporary, semipermanent, and/or semitemporary.

A "computer," "computer system," "host," "server," or "processor" can be, for example and without limitation, a processor, microcomputer, minicomputer, server, mainframe, laptop, personal data assistant (PDA), wireless e-mail device, cellular phone, pager, processor, fax machine, scanner, or any other programmable device configured to transmit and/or receive data over a network. Computer systems and computer-based devices disclosed herein can include memory for storing certain software modules used in obtaining, processing, and communicating information. It can be appreciated that such memory can be internal or external with respect to operation of the disclosed embodiments. The memory can also include any means for storing software, including a hard disk, an optical disk, floppy disk, ROM (read only memory), RAM (random access memory), PROM (programmable ROM), EEPROM (electrically erasable PROM) and/or other computer-readable media. Non-transitory computer-readable media, as used herein, comprises all computer-readable media except for a transitory, propagating signals.

Different types of modular wall systems can be formed from multiple modular wall structures arranged to define multiple work spaces and meeting areas. For example, modular wall structures can be freestanding, such that the modular wall structures can be provided without any base units. Modular wall structures can form individual work surfaces and/or define individual work spaces, in some cases, in association with a desk or table, for example. In certain embodiments, multiple modular wall structures can be arranged to define an enclosure.

In various embodiments disclosed herein, a single component can be replaced by multiple components and multiple components can be replaced by a single component to perform a given function or functions. Except where such substitution would not be operative, such substitution is within the intended scope of the embodiments.

Some of the figures can include a flow diagram. Although such figures can include a particular logic flow, it can be appreciated that the logic flow merely provides an exemplary implementation of the general functionality. Further, the logic flow does not necessarily have to be executed in the order presented unless otherwise indicated. In addition, the logic flow can be implemented by a hardware element, a software element executed by a computer, a firmware element embedded in hardware, or any combination thereof.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

We claim:

1. A modular wall structure comprising:

(a) a first modular unit, the first modular unit having a first face defined by a first perimeter; wherein the first modular unit is a first triangular unit comprising a first frame, the first frame including the first face, a first side panel, a second side panel, and a third side panel, wherein each of the first triangular unit first side panel, second side panel, and third side panel project outwardly from the first face; and (b) a second modular unit, the second modular unit having a second face defined by a second perimeter; wherein the second modular unit is a second triangular unit comprising a second frame, the second frame including the second face, a first side panel, a second side panel, and a third side panel, wherein each of the second triangular unit first side panel, second side panel, and third side panel project outwardly from the second face; and wherein the first modular unit is operably, selectively, and reversibly coupled to the second modular unit;

wherein each of the first modular unit and the second modular unit defines a truncated triangular pyramid shape;

wherein one or more corners of the first modular unit and the second modular unit are truncated; and wherein each of the first and second frames comprise a plurality of ball couplings and stick connectors, wherein the plurality of ball couplings and stick connectors is configured to form a perimeter for one or more of the first side panel, the second side panel, the third side panel, and the first face of the first triangular unit and/or one or more of the first side panel, the second side panel, the third side panel, and the second face of the second triangular unit.

2. The modular wall structure of claim 1, wherein the first face of the first modular unit and the second face of the second modular unit have shapes of different sizes.

3. The modular wall structure of claim 2, further comprising a plurality of first modular units operably connectable to a plurality of second modular units.

4. The modular wall structure of claim 1, wherein the first modular unit and the second modular unit are coupled with a fastener selected from the group consisting of magnets, pins, bolts, U-channels, clamps, and combinations thereof.

5. The modular wall structure of claim 1, further comprising a base unit, the base unit being configured to support the first modular unit and the second modular unit.

6. The modular wall structure of claim 5, wherein the base unit comprises wheels.

7. The modular wall structure of claim 1, wherein the first modular unit and the second modular unit are collapsible.

8. The modular wall structure of claim 1, wherein the first modular unit and the second modular unit are stackable.

9. The modular wall structure of claim 1, wherein the first face of the first triangular unit and the second face of the second triangular unit are selectively removable.

10. The modular wall structure of claim 1, wherein the first triangular unit further comprises a first triangular-shaped rear face panel, wherein the first triangular-shaped rear face panel is supported by the first frame, is set apart from the first face, and is parallel to the first face.

11. The modular wall structure of claim 10, wherein the first face or the first triangular-shaped rear face panel are transparent or semi-transparent.

12. The modular wall structure of claim 11, wherein the first triangular-shaped rear face panel is selectively attachable to or is monolithically formed as a unitary structure with the first frame.

13. The modular wall structure of claim 1, wherein the first side panel, the second side panel, and the third side panel of the first frame are pivotable relative to the first face.

14. The modular wall structure of claim 1, wherein the first frame and the first face are provided in a first unassembled configuration where the first side panel, second side panel, and third side panel are parallel with the first face, and a second assembled configuration where the first side panel, second side panel, and third side panel are pivoted between 70° and 120° relative to the first face.

15. The modular wall structure of claim 1, wherein the first triangular unit and the second triangular unit are wired for electrical applications.

* * * * *